US007520268B1

(12) United States Patent
Sims, Jr.

(10) Patent No.: US 7,520,268 B1
(45) Date of Patent: Apr. 21, 2009

(54) FUEL RAIL DAMPING ASSEMBLY INCLUDING AN INSERT

(75) Inventor: Dewey M. Sims, Jr., Wayne, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/050,681

(22) Filed: Mar. 18, 2008

(51) Int. Cl.
*F02M 63/00* (2006.01)
*F02M 63/02* (2006.01)

(52) U.S. Cl. ..... 123/447; 123/456

(58) Field of Classification Search ..... 123/447, 123/456, 457, 468, 469; 138/26, 30, 28
See application file for complete search history.

(56) References Cited

U.S. PATENT DOCUMENTS 3,018,799 A 1/1962 Volkmann et al.
3,020,928 A 2/1962 Peet
6,418,909 B2 7/2002 Rossi et al.
6,513,500 B2 2/2003 Braun et al.
6,655,354 B2 12/2003 Curran et al.
6,871,635 B2 3/2005 Curran et al.
6,871,637 B2 3/2005 Tsuchiya et al.
6,901,914 B1 6/2005 Becene et al.
2002/0139351 A1 10/2002 Braun et al.
2003/0111057 A1 6/2003 Curran et al.
2004/0000291 A1 1/2004 Tsuchiya et al.
2004/0035399 A1 2/2004 Curran et al.
2006/0081220 A1 4/2006 Sims, Jr. et al.

*Primary Examiner*—Mahmoud Gimie
(74) *Attorney, Agent, or Firm*—Michael Best & Friedrich LLP

(57) ABSTRACT

A damping assembly for use with a fuel rail. The damping assembly includes a damper configured to be positioned substantially within the fuel rail. The damper includes a wall and defines a longitudinal axis. A portion of the wall is moveable toward the longitudinal axis from a first position to a second position. The damping assembly also includes an insert positioned substantially within the damper and including a body having a surface. The surface is spaced apart from the moveable portion of the wall when the moveable portion is in the first position.

20 Claims, 4 Drawing Sheets

FUEL RAIL DAMPING ASSEMBLY INCLUDING AN INSERT

BACKGROUND

The present invention relates to fuel rails for fuel systems of internal combustion engines, and, more particularly, to dampers positioned within the fuel rails for damping pressure pulsations created by fuel injectors.

Fuel rails, or manifolds, typically supply fuel to fuel injectors that inject the fuel into corresponding inlet ports of an engine. Electromagnetic fuel injectors deliver fuel to the engine in metered pulses which are appropriately timed to the engine operation. The sequential energization of the fuel injectors induces pressure pulsations within the fuel rails that may create various problems. For example, the pressure pulsations may improperly distribute fuel to the injectors, which can adversely affect tailpipe emissions and driveability, and/or may induce fuel line hammering, which can result in vibration and audible noise.

It is known to utilize a damper element inside a fuel rail to effectively minimize or dampen pressure pulsations created by fuel injectors. It is also known to use a self-damping fuel rail to dampen the pressure pulsations. However, such damper elements and self-damping fuel rails may fatigue under high operating pressures.

SUMMARY

In one embodiment, the invention provides a damping assembly for use with a fuel rail. The damping assembly includes a damper configured to be positioned substantially within the fuel rail. The damper includes a wall and defines a longitudinal axis. A portion of the wall is moveable toward the longitudinal axis from a first position to a second position. The damping assembly also includes an insert positioned substantially within the damper and including a body having a surface. The surface is spaced apart from the moveable portion of the wall when the moveable portion is in the first position.

In another embodiment, the invention provides a fuel system including a fuel rail having at least one fuel outlet and a damper positioned substantially within the fuel rail. The damper includes a wall and defines a longitudinal axis. A portion of the wall is moveable toward the longitudinal axis from a first position to a second position. The fuel system also includes an insert positioned substantially within the damper and including a body having a surface. The surface is spaced apart from the moveable portion of the wall when the moveable portion is in the first position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
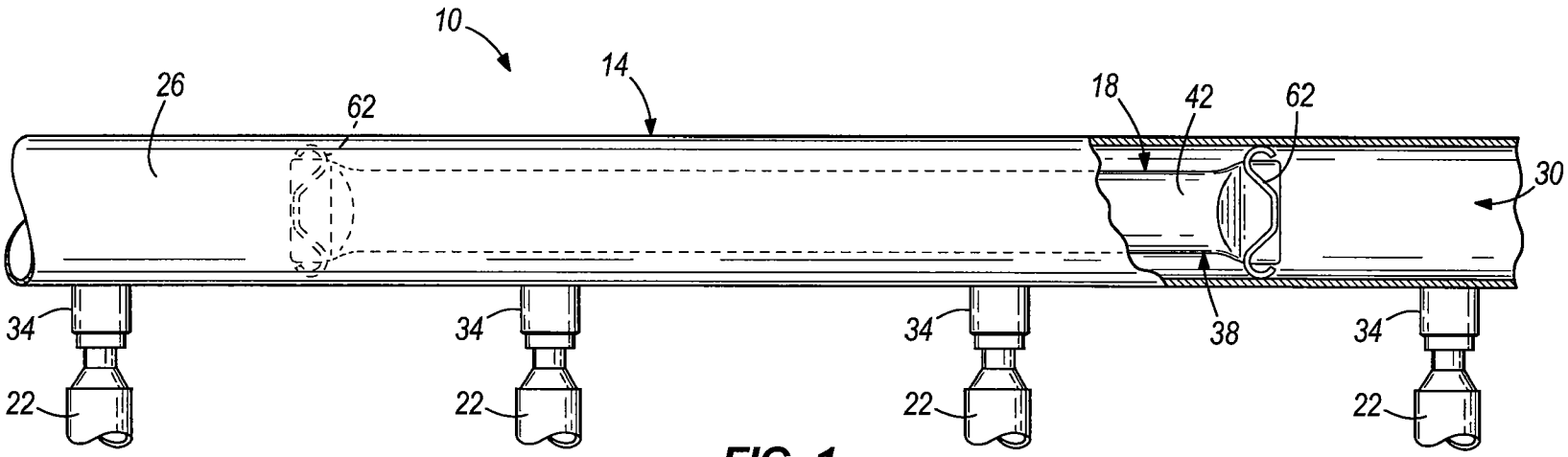
FIG. 1 is a partial cross-sectional view of a fuel system including a damping assembly embodying the invention.

FIG. 1 illustrates a fuel system 10 embodying the present invention. The illustrated fuel system 10 includes a fuel rail 14, a damping assembly 18, and a plurality of fuel injectors 22 coupled to the fuel rail 14. In the illustrated embodiment, the fuel rail 14, or manifold, includes a wall 26 defining a fuel passageway 30 and four fuel outlets 34. The fuel outlets 34 supply fuel (e.g., gasoline, diesel fuel, etc.) from the fuel passageway 30 to a fuel-injected internal combustion engine through the illustrated fuel injectors 22. In other embodiments, the fuel rail 14 may include fewer or more outlets 34 than the number illustrated to match the number of fuel injectors 22 and inlet ports of the engine.

Figure 2:
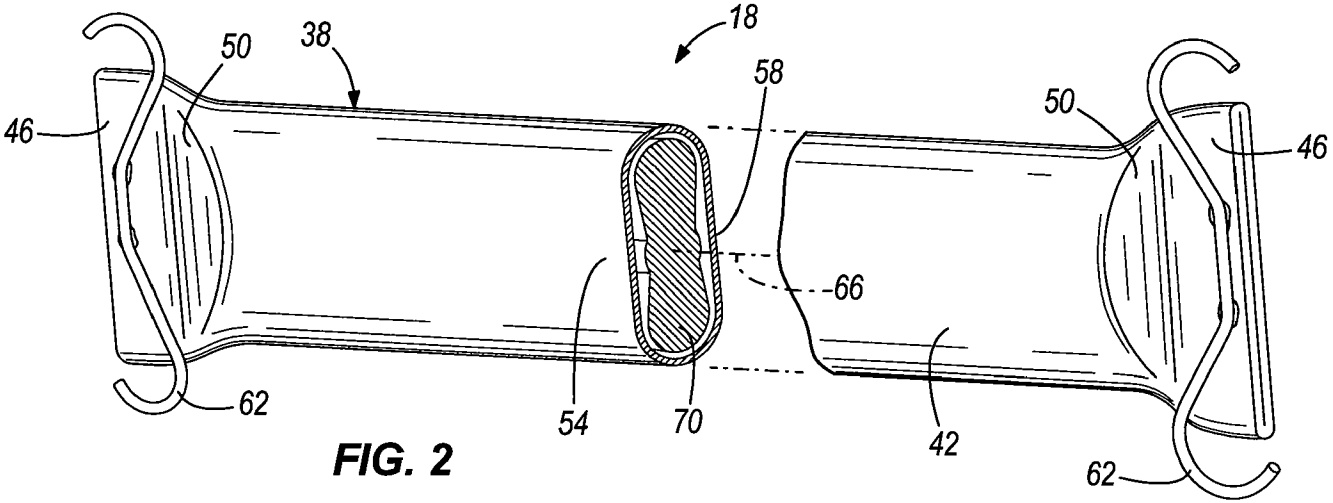
FIG. 2 is a perspective cross-sectional view of the damping assembly shown in FIG. 1, the damping assembly including a damper and an insert positioned within the damper.

As shown in FIGS. 1 and 2, the damping assembly 18 includes a damper 38 positioned substantially within the fuel rail 14. One example of such a damper is illustrated and described in U.S. Pat. No. 6,418,909, issued Jul. 16, 2002, the entire contents of which are hereby incorporated by reference. The illustrated damper 38 includes a wall 42 in the shape of a generally elongated tube. In the illustrated embodiment, the wall 42 is formed of stainless steel and has a generally oval-shaped cross-section. In other embodiments, the wall 42 may be composed of a different material (e.g., a plastic or elastomeric material) and/or may have a different cross-sectional shape (e.g., rectangular, circular, oblong, or the like).

The wall 42 includes two flattened end portions 46, tapered portions 50 adjacent to each flattened end portion 46, and first and second moveable portions 54, 58 extending between the tapered portions 50. As shown in FIG. 1, support members 62 are coupled to the flattened end portions 46 of the wall 42 to help hold and position the damper 38 within the fuel passageway 30. In some embodiments, the support members 62 are composed of copper coated steel and are welded to the flattened end portions 46. In other embodiments, the support members 62 are attached to the flattened end portions 46 by clipping, adhesives, fasteners, or the like.

Figure 4:
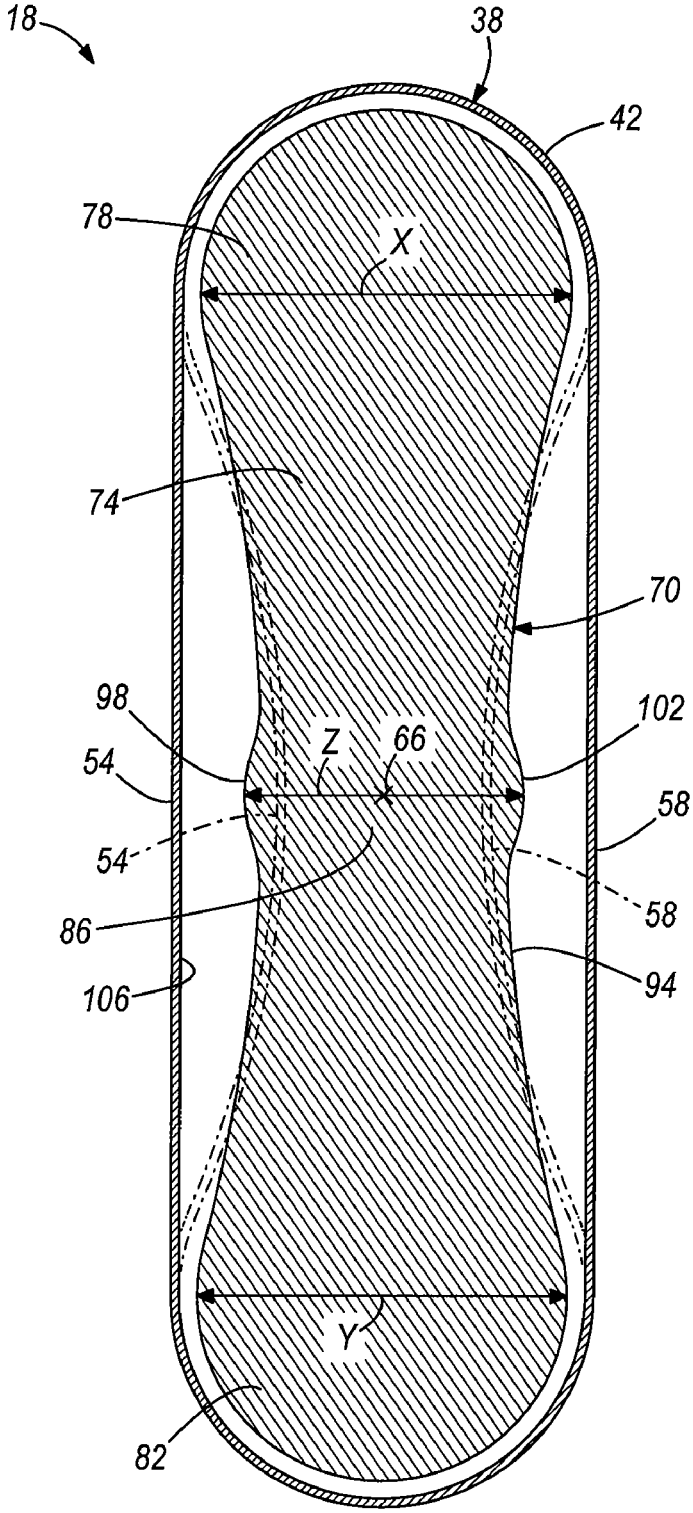
FIG. 4 is a cross-sectional view of the damping assembly shown in FIG. 2 with the damper in a resting condition.

In the illustrated embodiment, the moveable portions 54, 58 are located on substantially opposite sides of the wall 42. When the damper 38 is exposed to an increased operating pressure due to pressure pulsations caused by energization of the fuel injectors 22, the first and second moveable portions 54, 58 move inwardly toward a longitudinal axis 66 generally extending through a center of the damper 38. For example, as shown in FIG. 4, the moveable portions 54, 58 move from a generally planar, or straight, position (shown in solid lines) when the damper 38 is in a resting condition (e.g., when the operating pressure is substantially equal to the ambient pressure) to a deflected position (shown in broken lines and discussed further below) when the damper 38 is in an operating condition (e.g., when the operating pressure is substantially greater than the ambient pressure). In the illustrated embodiment, the deflected position is equivalent to when the operating pressure is approximately nine bar. The inward movement of the moveable portions 54, 58 helps dampen pressure pulsations, thereby reducing negative effects (e.g., noise, vibrations, improper fuel distribution, etc.) that may result from energization of the fuel injectors 22.

Figure 3:
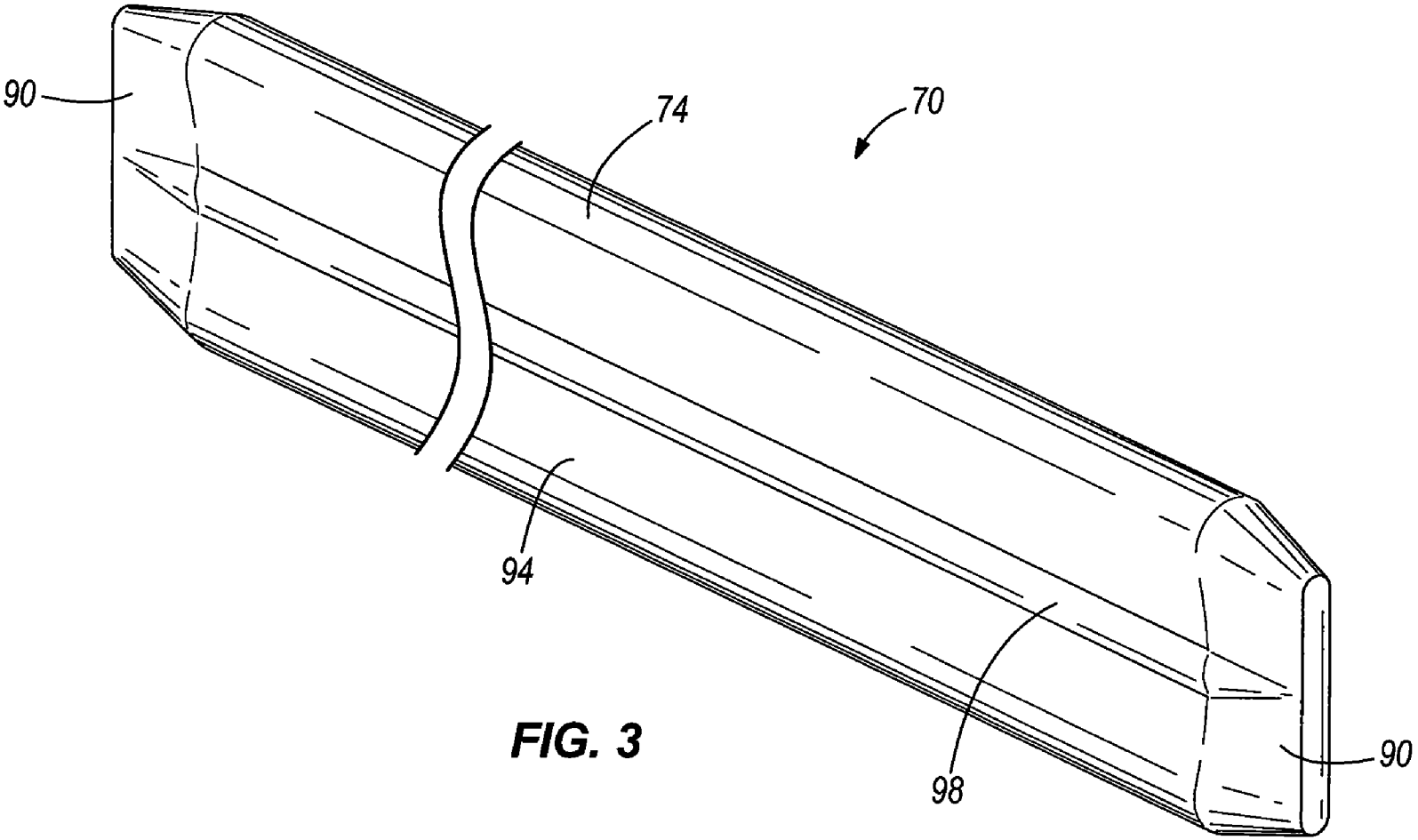
FIG. 3 is a perspective view of the insert shown in FIG. 2.

Referring to FIGS. 2 and 3, the damping assembly 18 also includes an insert 70 positioned substantially within the damper 38. When the damper 38 is in the operating condition, the insert 70 engages the moveable portions 54, 58 of the wall 42 to inhibit further movement toward the longitudinal axis 66. The illustrated insert 70 is composed of a plastic material such that the insert 70 is sufficiently rigid to withstand forces applied by the moveable portions 54, 58 of the wall 42 without substantially or permanently deforming, yet lightweight such that the insert 70 does not greatly increase the overall weight of the damping assembly 18. In other embodiments, the insert 70 may be composed of another suitably rigid material and/or the damping assembly 18 may include multiple, smaller inserts positioned within the damper 38. Additionally or alternatively, the insert 70 may have a substantially tubular shape similar to the damper 38 if the material of the insert is suitably rigid.

As shown in FIG. 4, the insert 70 includes a body 74 having a generally dumbbell-shaped cross-section. The body 74 includes a first portion 78 (e.g., the top portion in FIG. 4) having a first width X, a second portion 82 (e.g., the bottom portion in FIG. 4) having a second width Y, and a third portion 86 intermediate the first and second portions 78, 82 and having a third width Z. The illustrated first and second widths X, Y are approximately the same length, but are substantially larger than the third width Z to create the dumbbell-shaped cross-section of the body 74. For example, in the embodiment shown in FIG. 4, the ratio of the first width X (or the second width Y) to the third width Z is between about 1.2 and about 1.6. In the illustrated embodiment, the first and second portions 78, 82 are rounded to complement the generally oval-shaped cross-section of the damper 38. In other embodiments, the first and second portions 78, 82 may be, for example, substantially square to complement a damper having a generally rectangular-shaped cross-section.

As shown in FIG. 3, the insert 70 includes two end portions 90 that are tapered to complement the tapered portions 50 of the damper 38. When the insert 70 is positioned within the damper 38 and the damper 38 is in the resting condition, the end portions 90 of the insert 70 fit snugly within the corresponding tapered portions 50 of the damper 38. The snug fit between the end portions 90 and the tapered portions 50 inhibits shifting of the insert 70 within the damper 38 and suspends the insert 70 such that a surface 94 of the rest of the body 74 is spaced apart from the wall 42 of the damper 38 when in the resting condition. The snug fit also inhibits the tapered portions 50 of the damper 38 from deflecting toward the longitudinal axis 66 when in the operating condition.

Figure 5:
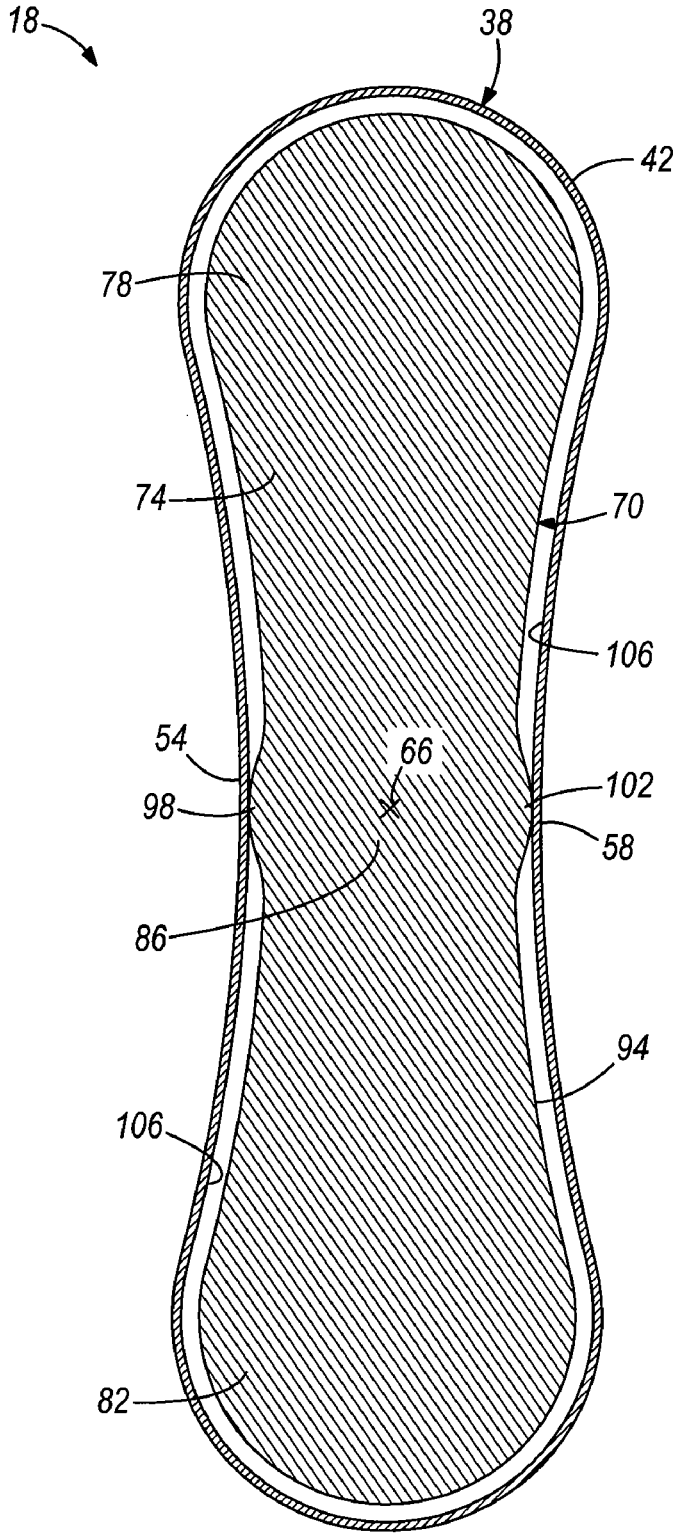
FIG. 5 is the cross-sectional view of FIG. 4 with the damper in an operating condition.

As shown in FIGS. 3 to 5, the insert 70 includes two projections 98, 102 coupled to the third, or middle, portion 86 of the body 74. In the illustrated embodiment, the projections 98, 102 are formed as a single piece with the body 74 and define a portion of the surface 94. In other embodiments, the projections 98, 102 may be separate pieces that are coupled to the body 74 via fasteners, adhesives, or the like after the body 74 is manufactured. In the illustrated embodiment, one projection 98, 102 is formed on each side of the body 74 and extends along substantially the entire length of the body 74 between the end portions 90. In some embodiments, the projections 98, 102 may be a circular bump coupled near a midpoint of the insert 70 on each side of the body 74, or the projections 98, 102 may be a series of small bumps spaced apart along the length of the body 74. The projections 98, 102 engage (e.g., contact) the moveable portions 54, 58 of the wall 42 when the moveable portions 54, 58 are in the deflected position (FIG. 5) to inhibit further movement toward the longitudinal axis 66. In the illustrated embodiment, the projections 98, 102 engage the moveable portions 54, 58 along a line of contact substantially equal to the length of the body 74 and substantially parallel to the longitudinal axis 66. In other embodiments, the projections 98, 102 may engage the moveable portions 58, 58 at discrete bands or points of contact of varying lengths along of the body 74. Inhibiting further movement of the moveable portions 54, 58 helps reduce stress, and thereby the possibility of premature fatigue failure, of the moveable portions 54, 58.

Referring to FIGS. 4 and 5, an air gap 106, or air spring, is defined between the wall 42 of the damper 38 and the surface 94 of the insert 70. When the damper 38 is in the resting condition (FIG. 4), the air gap 106 surrounds substantially the entire insert 70. When the damper 38 is in the operating condition (FIG. 5), the air gap 106 is mainly present around the first and second portions 78, 82 of the insert 70. Accordingly, the size of the air gap 106 is reduced in the operating condition, increasing the pressure of air within the air gap 106. As the moveable portions 54, 58 move from the rest position shown in FIG. 4 to the deflected position shown in FIG. 5, the volume of the air gap 106 is approximately halved, increasing the pressure in the air gap 106 by about one bar. This means that the fuel pressure needed to deflect the moveable portions 54, 58 of the wall 42 to the position shown in FIG. 5 will increase by about one bar (e.g., from five bar to six bar). This extra one bar of air pressure improves the dampening ability of the damper 38 because the moveable portions 54, 58 move faster and respond quicker to pressure pulsations. The air gap 106, thereby, helps quickly return the moveable portions 54, 58 of the wall 42 from the deflected position (FIG. 5) to the generally planar position (FIG. 4). The air gap 106 also helps inhibit other portions of the wall 42 from moving toward the longitudinal axis 66 when the operating pressure increases. In some embodiments, other fluids (e.g., helium gas, compressible foam, etc.) aside from ambient air may additionally or alternatively be introduced into the air gap 106 to facilitate damping.

In the illustrated embodiment, the shape of the insert 70, and, in particular, the cross-sectional shape of the insert 70, is determined using finite element analysis (FEA). First, a damper model is generated having a cross-sectional shape substantially similar to the actual damper 38 (e.g., oval-shaped). In addition, the damper model is modeled to have similar material characteristics and properties to the actual damper 38 (e.g., the moveable portions 54, 58 of the wall 42, the stiffness of the damper material, etc.).

Next, a maximum desired operating pressure is applied to the damper model. The maximum desired operating pressure is substantially equal to the highest operating pressure the actual damper 38 should be exposed to in order to reduce the possibility of fatigue failure due to stress caused by movement of the moveable portions 54, 58 of the wall 42. In the illustrated embodiment, the maximum desired operating pressure is approximately five bar. When the maximum desired operating pressure is applied to the damper model, the modeled moveable portions are moved inwardly, generating a resultant damper model.

Using the resultant damper model, an appropriate shape of an insert model is roughly determined. The insert model is configured to have substantially the same shape as the resultant damper model, minus manufacturing tolerances (e.g., a wall thickness of the damper 38) and the size of the air gap 106. Projections are modeled on the insert model such that the modeled projections extend from a middle portion (e.g., the third portion 86) of the insert model by an amount substantially equal to the size of the air gap 106. The actual insert 70 is then manufactured in accordance with the insert model.

In operation, the damper 38 begins in the resting condition (FIG. 4) such that the moveable portions 54, 58 of the wall 42 are in the generally planar position. When an internal combustion engine coupled to the fuel rail 14 requires fuel, the fuel injectors 22 are energized to inject fuel from the fuel passageway 30 into the engine. Energization of the fuel injectors 22 successively increases and decreases the operating pressure of the fuel within the fuel passageway 30, creating pressure pulsations within the fuel rail 14. In the illustrated embodiment, the operating pressure is typically around four bar. However, under some operating conditions, the operating pressure may increase to about nine bar. The fuel pressure could drop to zero bar when the system 10 is turned off.

When the operating pressure increases to, for example, five bar, the moveable portions 54, 58 of the wall 42 move to the deflected position (FIG. 5) to dampen the effects of the increased operating pressure. The projections 98, 102 of the insert 70 engage the moveable portions 54, 58 of the wall 42 such that, if the operating pressure increases beyond five bar, the insert 70 inhibits further movement of the moveable portions 54, 58 toward the longitudinal axis 66. In addition, the decreased size of the air gap 106 increases the pressure of the air or other fluids within the damper 38. This increased fluid pressure helps further counteract any forces on the wall 42 of the damper 38 due to the increased operating pressure in the fuel rail 14.

If the insert 70 was not present and the operating pressure increased to, for example, nine bar, the moveable portions 54, 58 of the wall 42 would move to the deflected position shown in broken lines in FIG. 4. Such extreme deflection of the moveable portions 54, 58 would create unnecessary stress on the wall 42 of the damper 38, which may lead to premature fatigue failure of the damper 38.

When the operating pressure decreases to, for example, ambient pressure, the moveable portions 54, 58 of the wall 42 are moved away from the longitudinal axis 66 back to the generally planar position (FIG. 4). In the illustrated embodiment, both the material properties (e.g., elasticity) of the wall 42 and the fluid within the air gap 106 help return the moveable portions 54, 58 to the generally planar position.

Positioning a substantially rigid insert within a damper allows the damper to be used with operating pressures up to about nine bar. The insert helps reduce stress on the damper by inhibiting the range of movement of moveable wall portions of the damper in response to increased operating pressures in the fuel rail. Limiting the range of movement of the damper wall decreases the possibility of fatigue failure and, thereby, increases the usable life of the damper. In addition, the insert defines an air spring inside the damper that helps return the moveable portions to a resting condition when the operating pressure in the fuel rail decreases to about ambient pressure.

Various features and advantages of the invention are set forth in the following claims.

What is claimed is:

1. A damping assembly for use with a fuel rail, the damping assembly comprising:

a damper configured to be positioned substantially within the fuel rail, the damper including a wall and defining a longitudinal axis, a portion of the wall being moveable toward the longitudinal axis from a first position to a second position, the wall including end portions and defining a sealed chamber between the end portions; and an insert positioned within the sealed chamber of the damper and including a body having a surface, the surface being spaced apart from the moveable portion of the wall when the moveable portion is in the first position.

2. The damping assembly of claim 1, wherein, when the moveable portion of the wall is in the second position, the surface engages the moveable portion to inhibit further movement toward the longitudinal axis.

3. The damping assembly of claim 2, wherein the insert includes a projection coupled to the body and defining at least a portion of the surface, and wherein the projection engages the moveable portion of the wall when the moveable portion is in the second position.

4. The damping assembly of claim 3, wherein an air gap is defined between the wall of the damper and the surface of the insert, the air gap being adjacent to the projection when the moveable portion of the wall is in the second position.

5. The damping assembly of claim 3, wherein the projection is formed as a single piece with the body of the insert.

6. The damping assembly of claim 1, wherein the body includes a first portion having a first width, a second portion having a second width, and a third portion intermediate the first and second portions and having a third width, and wherein the first and second widths are substantially larger than the third width.

7. The damping assembly of claim 6, wherein the insert includes a projection formed on the third portion of the body and defining at least a portion of the surface, and wherein the projection engages the moveable portion of the wall when the moveable portion is in the second position.

8. The damping assembly of claim 6, wherein an air gap is defined between the first portion of the body and the wall and between the second portion of the body and the wall.

9. The damping assembly of claim 1, wherein the insert includes a first end portion proximate one end of the damper and a second end portion proximate the other end of the damper, and wherein at least one of the first end portion and the second end portion is tapered.

10. The damping assembly of claim 1, wherein the insert is a separate component from the damper.

11. The damping assembly of claim 1, wherein the insert is substantially rigid.

12. A fuel system comprising:

a fuel rail including at least one fuel outlet;

a damper positioned substantially within the fuel rail, the damper including a wall and defining a longitudinal axis, a portion of the wall being moveable toward the longitudinal axis from a first position to a second position, the wall including end portions and defining a sealed chamber between the end portions; and an insert positioned within the sealed chamber of the damper and including a body having a surface, the surface being spaced apart from the moveable portion of the wall when the moveable portion is in the first position.

13. The fuel system of claim 12, wherein, when the moveable portion of the wall is in the second position, the surface engages the moveable portion to inhibit further movement toward the longitudinal axis.

14. The fuel system of claim 13, wherein the insert includes a projection coupled to the body and defining at least a portion of the surface, and wherein the projection engages the moveable portion of the wall when the moveable portion moves toward the longitudinal axis.

15. The fuel system of claim 14, wherein an air gap is defined between the wall of the damper and the surface of the insert, the air gap being adjacent to the projection when the moveable portion of the wall is in the second position.

16. The fuel system of claim 12, wherein the body includes a first portion having a first width, a second portion having a second width, and a third portion intermediate the first and second portions and having a third width, and wherein the first and second widths are substantially larger than the third width.

17. The fuel system of claim 16, wherein the insert includes a projection formed on the third portion of the body and defining at least a portion of the surface, and wherein the projection engages the moveable portion of the wall when the moveable portion is in the second position.

18. The fuel system of claim 16, wherein an air gap is defined between the first portion of the body and the wall and between the second portion of the body and the wall.

19. The fuel system of claim 12, wherein the insert includes a first end portion proximate one end of the damper and a second end portion proximate the other end of the damper, and wherein at least one of the first end portion and the second end portion is tapered.

20. The fuel system of claim 12, wherein the insert is a substantially rigid, separate component from the damper.

* * * * *